United States Patent [19]

O'Brien et al.

[11] 3,993,299

[45] Nov. 23, 1976

[54] DIRECT MAIL ADVERTISING BOOKLET AND METHOD OF PRODUCTION

[75] Inventors: William J. O'Brien, Plandome Heights, N.Y.; John Sakal, Dayton, Ohio

[73] Assignee: The Standard Register Company, Dayton, Ohio

[22] Filed: June 23, 1975

[21] Appl. No.: 589,715

Related U.S. Application Data

[62] Division of Ser. No. 330,214, Feb. 7, 1973, Pat. No. 3,899,381.

[52] U.S. Cl. ..... 270/5; 229/69; 270/37; 270/53

[51] Int. Cl.[2] ..... B41F 13/58

[58] Field of Search ..... 270/4, 5, 10, 32, 37, 270/41, 43, 52; 229/68 R, 73, 69, 71; 93/36 MM, 36 M, 36.01, 35 R, 61 A, 63 R, 63 M, 73

[56] References Cited

UNITED STATES PATENTS

| | | | |
|---|---|---|---|
| 2,969,003 | 1/1961 | Rapp | 93/63 M |
| 3,104,799 | 9/1963 | Steidinger | 229/69 |
| 3,305,247 | 2/1967 | Fulk | 270/5 X |
| 3,411,699 | 11/1968 | Pine | 229/73 |
| 3,554,438 | 1/1971 | Malderghem | 229/69 |
| 3,665,817 | 5/1972 | Katz | 270/37 |
| 3,743,273 | 7/1973 | Katz | 270/37 |

*Primary Examiner*—Edgar S. Burr
*Assistant Examiner*—A. Heinz
*Attorney, Agent, or Firm*—Jacox & Meckstroth

[57] ABSTRACT

A low cost self-contained, direct-mail advertising booklet, particularly adapted to be a self-mailer type of booklet. A plurality of continuous strips or sheets of paper-like material are superposed and attached together to form a series of booklets in a continuous web. Personalized information such as a name, address, etc. is applied to a portion of the web or to a card or sheet or the like which is attached to the web. The web is folded so that the personalized information is used as a mailing address for the booklet. Separation of the booklet from the web may occur before or after folding occurs. The portion of each booklet which carries the personalized information may be readily removed from other portions of the booklet and placed in the mail by the receiver of the booklet to indicate his acceptance of an offer or the like set forth in the booklet.

5 Claims, 6 Drawing Figures

XY Co
Memo
Solvent
XY Co.
PAD
Mr. R. Jones
111 S.W. 6th
Cardiel Okla.
XY Co.
Main St.
USA

DIRECT MAIL ADVERTISING BOOKLET AND METHOD OF PRODUCTION

RELATED APPLICATION

This application is a division of U.S. Patent Application Ser. No. 330,214, filed Feb. 7, 1973 now U.S. Pat. No. 3,899,381.

BACKGROUND OF THE INVENTION

In the past, direct-mail advertising booklets have been produced in quantities by various methods, and each booklet has been mailed in a special envelope to a prospective customer with a personalized cover letter. Of course, such production of the booklets, with cover letters, has been relatively expensive. For example, several pieces have been produced and then brought together for mailing in an envelope or the like.

SUMMARY OF THE INVENTION

The invention comprises the production of booklets, such as direct mail advertising booklets, particularly the self-mailer type of direct mail advertising booklets. The booklets are produced by forming a continuous web which includes a plurality of superposed paper-like continuous strips or sheets. The sheets or strips are scored or partially severed at spacedapart intervals to provide sections. The strips are adhesively attached together. Scoring of the strips to provide sections may occur before or after the strips are collated and attached together. A portion of each section of one of the strips is provided with personalized information, such as a name, address, etc. The web is then burst into booklet portions and then folded. Alternatively, portions of the web are folded, and then the web is burst into booklet portions. The booklet is then ready for mailing. The personalized portion of each booklet can be readily removed by the recipient and mailed back to the sender of the booklet to indicate acceptance of an offer or the like set forth in the booklet.

Thus, an object of this invention is to provide a personalized self-mailer type of direct mail advertising booklet which can be produced at relatively low costs.

Another object of the invention is to provide a method or methodds of producing such a booklet.

Other objects and advantages of the invention reside in the construction of parts, the combination thereof, the method of manufacture, and the manner of use, as will become more apparent from the following description.

DETAILED DESCRIPTION OF THE INVENTION

Figures 1, 2, 3, 4, 5, 6:
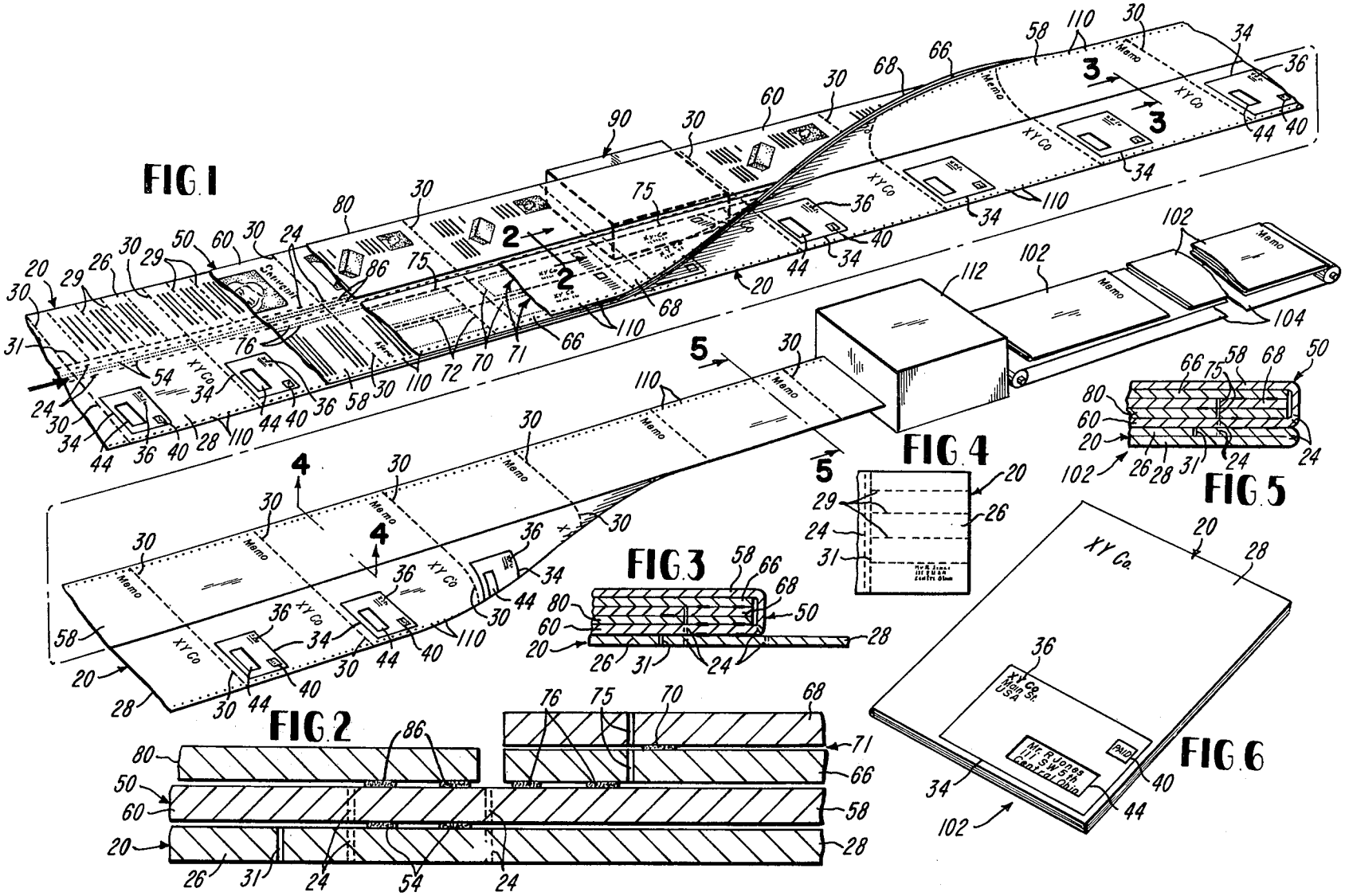
FIG. 1 is a schematic type of perspective view illustrating a method and apparatus for producing direct mail advertising booklets in accordance with this invention.
FIG. 2 is an enlarged sectional view taken substantially on line 2—2 of FIG. 1.
FIG. 3 is an enlarged sectional view taken substantially on line 3—3 of FIG. 1 and drawn on a smaller scale than FIG. 2.
FIG. 4 is a view taken substantially on line 4—4 of FIG. 1
FIG. 5 is an enlarged sectional view taken substantially on line 5—5 of FIG. 1 and shown on a smaller scale than FIG. 2.
FIG. 6 is a perspective view showing a direct mail advertising booklet made in accordance with this invention.

FIG.1 illustrates a method of production of booklets according to this invention. A continuous strip or sheet 20 of paper-like material has a plurality of closely spaced longitudinally extending score lines 24 at the central portion thereof. The score lines 24 divide the strip 20 into a longitudinally extending portion 26 and a longitudinally extending portion 28. The continuous strip 20 has transverse perforation lines 30 at spaced-apart positions, which divide the continuous strip 20 into sections. As shown in the upper left hand part of FIG. 1, the portion 26 in each section has printing thereupon which is separated by transverse perforation lines 29 and longitudinal perforation lines 31. The portion 28 of each section has a printed rectangle 34, a return address 36 and a postage permit statement 40 printed thereupon. Within the rectangle 34 is a window or opening 44.

Positioned upon the continuous strip 20 is a continuous strip 50 which has substantially the same width as the continuous strip 20. The strip 50 has score lines 24 which are directly above the score lines 24 of the strip 20. The strip 50 is attached to the strip 20 by adhesive spots or lines 54. The strip 50 is divided into portions 58 and 60 by the score lines 24 and each portion thereof contains printed advertising material or the like on one or both of the surfaces thereof. Transverse perforation lines 30 in the strip 50 are directly above the transverse perforation lines 30 in the strip 20.

As shown in FIGS. 1 and 2, positioned upon the portion 58 of the strip 50 and having a width substantially equal to one-half the width of the strips 20 and 50 are superposed continuous strips 66 and 68 which are attached together by transverse longitudinal lines or spots 70 of adhesive material to form envelopes 71 which are partially separated from the strips 66 and 68 by transverse and longitudinally extending perforation lines 72. The strip 66 is attached to the portion 58 of the strip 50 by lines or spots 76 of adhesive material. The strips 66 and 68 have longitudinal score lines 75. The upper surface of the envelopes 71 has address information and postage indicia printed thereupon. The address information is usually that of the mailer of the booklets.

Positioned upon the portion 60 of the strip 50 and having a width substantially equal to one-half the width of the strip 50 is a continuous strip 80 which has advertising material printed upon one or both surfaces thereof. The strip 80 and the strips 66 and 68 have spaced-apart transverse perforation lines 30 which are directly above the perforation lines 30 of the strips 20 and 50. The strip 80 is attached to the portion 60 of the strip 50 by lines or spots 86 of adhesive material, as shown in FIG. 2. The perforation lines 30 may be applied to the strips 20, 50, 66, 68 and 80 after they are attached together, if desired, rather then prior to collating and attachment, in the manner discussed above.

After such positioning and attaching together of the strips 20, 50, 80, 66 and 68, the strips are moved over high speed printer apparatus 90 or the like, which is ordinarily computer operated, and personalized information, such as the name and address of a recipient, is applied to the lower surface of the portion 26 of the strip 20. Feed holes 110 are shown in the strips 20, 50, 80, 66 and 68 for movement thereof.

Then, as illustrated in the upper right hand part of FIG. 1, the portion 58 of the strip 50 and the stips 66 and 68 are then folded over the stips 80, 50 and 20, so that the strip 68 comes into engagement with the strip 80, and the portion 58 of the strip 50 is then uppermost above the strip 80, as shown in FIG. 3. Then as illustrated in the lower part of FIGS. 1 and 5, the portion 28 of the strip 20 is folded under the portion 26 of the strip 20.

Thus a web as illustrated in FIG. 5 is formed. The web is moved through burster apparatus 112, or the like, and the web is severed at the perforations lines 30 to form booklets 102, as shown in FIG. 1, supported upon a conveyor belt 104, or the like. When the booklets 102 are removed from the conveyor belt 104 and turned over, they appear as shown in FIG. 6, with the personalized name and address printed upon the portion 26 of the strip 20, appearing through the window 44 of the portion 28 of the strip 20. The booklet 102 is then ready for mailing to the name and address which appears in the window 44.

After the person receives the booklet 102, he may sever a personalized part of the portion 26 (a part which carries his name and address) from the strip 20. Such severance occurs along perforation lines 29 and 31. The severed part may then be placed into an envelope portion 71 which can be severed from the strips 66 and 68. Such severance of an envelope portion 71 occurs along perforation lines 72 and 75. The envelope 71 which has the personalized portion 26 of the strip 20 therein is then placed in the mail for transmittal to the addressee named on the envelope 71.

Instead of severing a personalized portion from the strip 20, a card or sheet portion or the like may be removably attached to and carried by a surface of the strip 20 and removed therefrom and mailed without enclosure or placed in an envelope, such as the envelope 71 for mailing.

It is to be understood that in accordance with this invention personalized information may be applied to sheets or cards which are attached to a strip in spaced-apart relationship along the length of the sheet. For example, one of the continuous strips in a continuous web may have spaced-apart card members or sheets attached thereto by adhesive means or by staples or the like along the length of the strip and personalized information is applied thereto in a manner such as that discussed above.

Although the preferred embodiment of the invention has been described, it will be understood that within the purview of this invention various changes may be made in the form, details, proportion and arrangement of parts, the combination thereof, and manner of use which generally stated consist in booklet structure and method of production thereof as defined in the appended claims.

The invention having thus been described, the following is claimed:

1. The high speed method of producing booklets for bulk mailing comprising:

superposing a plurality of continuous strips of paper-like material, there being a first strip of said plurality of continuous strips, there being a second strip of said plurality of continuous strips, each of said first and second continuous strips having substantially the same given width dimension, each of the first and second continuous strips having a longitudinally extending centrally located attachment region dividing the stip into a first portion and a second portion, the first continuous strip having spaced-apart items of repetitive printed material thereupon, each item of repetitive printed material being identical to each of the other of said items of repetitive printed material, the second strip of said plurality of strips having longitudinally spaced-apart openings in the first portion thereof laterally spaced from the longitudinally extending centrally located attachment region, attaching said first and second strips together along said longitudinally extending centrally located attachment regions printing personalized name and address information items upon the second portion of said second strip, each personalized name and address item being in substantial lateral alignment with one of the spaced-apart openings, each personalized name and address information item being different from all other name and address information items, longitudinally folding the second strip along said longitudinally extnding centrally located attachment region to superpose the first portion thereof over the second portion thereof, each of said openings in vertical alignment with one of said personalized name and address information items so that each personalized name and address information item appears through its respective opening, longitudinally folding each other strip having said given width dimension along the longitudinally extending centrally located attachment region to complete the formation of a folded web having two substantially planar exterior surfaces and having a width substantially equal to one-half the width of the first strip prior to folding thereof, with the first portions of the first and second strips forming the two exterior surfaces of the folded web, separating the web into individual sections by severing the web along spaced-apart transverse lines to form booklets.

2. The high speed method of producing personalized booklets for bulk mailing comprising:

providing a first continuous strip of paper-like material having a given width, the first continuous strip having a longitudinally extending fold line along the length thereof at substantially the transverse center thereof, the first continuous strip having an upper surface and a lower surface, the first continuous strip having spaced-apart regions along the length thereof, in each of the spaced-apart regions there being a first longitudinal portion on one side of the fold line and a second longitudinal portion on the other side of the fold line, the first portion in each of the spaced-apart areas of the first continuous strip having an opening therein, positioning in superposed relation upon the second portion of the first continuous strip of paper-like material along the length thereof a plurality of second continuous strips of paper-like material having a width substantially equal to one-half said given width, attaching the second continuous strips together and to the first continuous strip along a portion thereof adjacent the longitudinally extending fold line of the first continuous strip, printing personalized name and address information upon the spaced-apart regions on the lower surface of the second portion of the first strip of paper-like material, in lateral alignment with the openings in the first portion of the first continuous strip, there being a different name and address printed in each of the spaced-apart regions on the lower surface of the second portion of the first continuous strip of paper-like material, longitudinally folding the first continuous strip so that the lower surface of the first portion thereof engages the lower surface of the second portion thereof for exposing the personalized name and address information through the openings in the first portion of the first continuous strip, severing the strips along spaced-apart transverse lines.

3. The high speed method of producing personalized booklets for bulk mailing comprising:

superposing a first continuous strip of paper-like material and a second continuous strip of paper-like material, the second continuous strip being above the first continuous strip so that each strip has an upper surface and a lower surface, each of said strips having a given width, each of said strips having a longitudinally extending fold line along the length thereof at substantially the transverse center thereof, each of the first and second continuous strips having a first portion on one side of the fold line and a second portion on the other side of the fold line, each of the continuous strips having longitudinally spaced-apart areas along the length thereof, the first portion of the first continuous strip having an opening in each of the spaced-apart areas along the length thereof, attaching the first continuous strip and the second continuous strip together along the longitudinally extending fold lines thereof, superposing a third continuous strip of paper-like material having a width substantially equal to one-half said given width upon the second portion of the second continuous strip and attaching said third continuous strip along an edge thereof to the second continuous strip adjacent the longitudinally extending fold line along the length thereof, printing personalized name and address information items upon each of said spaced-apart areas of the first continuous strip on the lower surface of the second portion thereof, each of the personalized name and address information items being different from all of the other personalized name and address information items and in lateral alignment with one of the openings in the first portion of the first continuous strip, longitudinally folding the first portion of the first continuous strip under the second portion thereof exposing each of the personalized name and address information items through an opening in the first portion of the first continuous strip, longitudinally folding the first portion of the second continuous strip along the longitudinally extending fold line thereof and over the third continuous strip, severing the strips along spaced-apart transverse lines.

4. The high speed method of producing booklets for bulk mailing comprising:

superposing a first continuous strip and a second continuous strip with the second continuous strip above the first continuous strip, said continuous strips having the same given width, each of the continuous strips having longitudinally spaced-apart areas along the length thereof, each of the continuous strips having a central longitudinally extending attachment region, attaching the strips together along the central longitudinally extending attachment portions thereof, each of the continuous strips having a first portion on one side of said central longitudinally extending attachment region and a second portion on the other side of said central longitudinally extending attachment region, the first portion of the first strip having an opening in each of the longitudinally spaced-apart areas along the length thereof, superposing a third continuous strip having a width not greater than one-half said given width upon the second continuous strip and attaching the third continuous strip to the second continuous strip at each of the spaced-apart areas along the length thereof at positions spaced from said central longitudinally extending attachment region, the attachment of the third continuous strip to the second continuous strip being along a plurality of lines which are relatively angular with respect to the longitudinally extending attachment region to form at least one pocket in each of the spaced-apart areas of the second continuous strip, printing personalized name and address information upon the second portion of the first continuous strip upon each of the spaced-apart areas thereof in lateral alignment with said spaced apart openings, the personalized name and address information at each location being different from the name and address information at each other location, longitudinally folding the first portion of the first continuous strip over the second portion of the first continuous strip so that the name and address information at each location appears through one of said openings, longitudinally folding the first portion of the second continuous strip over the second portion of the second continuous strip and over the third continuous strip, and severing the strips along spaced-apart transverse lines.

5. The method of claim 4 in which the third continuous strip is attached to the second continuous strip at said spaced-apart areas thereof, there being at least one line of attachment which is parallel to the central longitudinally extending attachment portion and at least one line of attachment which is transverse to the central longitudinally extending attachment portion.

* * * * *